US007614877B2

(12) United States Patent
McCrorey et al.

(10) Patent No.: US 7,614,877 B2
(45) Date of Patent: Nov. 10, 2009

(54) DEVICE AND METHOD FOR A GAS BURNER

(75) Inventors: Paul E. McCrorey, Mt. Washington, KY (US); Paul Bryan Cadima, Prospect, KY (US); Shree Kumar, Karnataka (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/961,258

(22) Filed: Dec. 20, 2007

(65) Prior Publication Data

US 2009/0162801 A1 Jun. 25, 2009

(51) Int. Cl.
*F23C 9/00* (2006.01)

(52) U.S. Cl. ..... 431/354; 431/12; 431/349; 431/338; 431/284; 431/116; 126/39 E

(58) Field of Classification Search ..... 126/39 E; 431/349, 354, 284, 116, 338
See application file for complete search history.

(56) References Cited

U.S. PATENT DOCUMENTS 2,257,339 A * 9/1941 Parker ..... 126/39 J
2,447,211 A * 8/1948 Rousseau ..... 431/199
3,796,535 A * 3/1974 De Gouville ..... 431/349
5,133,658 A * 7/1992 Le Monnier De Gouville et al. ..... 431/349
5,490,778 A * 2/1996 Meijer ..... 431/349
6,035,846 A * 3/2000 Saleri ..... 126/39 H
6,089,219 A * 7/2000 Kodera et al. ..... 126/39 R
6,132,205 A * 10/2000 Harneit ..... 431/354
6,135,764 A * 10/2000 Kwiatek ..... 431/266
6,315,552 B1 * 11/2001 Haynes et al. ..... 431/285
6,325,619 B2 * 12/2001 Dane ..... 431/284
6,439,881 B2 * 8/2002 Haynes et al. ..... 431/354
6,439,882 B2 * 8/2002 Haynes et al. ..... 431/354
6,443,726 B2 * 9/2002 Atemboski et al. ..... 431/125
6,602,068 B2 * 8/2003 Atemboski et al. ..... 431/125
6,875,008 B1 * 4/2005 Martin et al. ..... 431/9
6,889,685 B2 * 5/2005 Dane ..... 126/39 B
7,001,176 B2 * 2/2006 Bettinzoli ..... 431/354
7,017,572 B2 3/2006 Cadima
7,083,123 B2 * 8/2006 Molla ..... 239/419.5

(Continued)

FOREIGN PATENT DOCUMENTS

WO WO 2005073630 A1 * 8/2005

*Primary Examiner*—Kenneth B Rinehart
*Assistant Examiner*—Jorge Pereiro
(74) *Attorney, Agent, or Firm*—Global Patent Operation; Douglas D. Zhang

(57) ABSTRACT

A gas range having a cook top and a gas burner assembly connected to a source of gas having a variable flow rate. The burner assembly is positioned in the cook top. The gas burner assembly has a burner body with a gas input, the gas input is in a first flow communication with a first chamber and a second flow communication with a second chamber. Each chamber has at least one port in an exterior wall for flow communication to an area external of the burner body for combustion of the gas. The second flow communication has a tripping pin to deflect flow during high flow conditions and to not deflect flow during low flow conditions. A burner cap is positioned on the burner body.

14 Claims, 7 Drawing Sheets

U.S. PATENT DOCUMENTS

2004/0029063 A1* 2/2004 Bettinzoli ..... 431/354
2004/0195399 A1* 10/2004 Molla ..... 239/594
2004/0241604 A1* 12/2004 Cadima ..... 431/354
2006/0121402 A1* 6/2006 Bettinzoli ..... 431/354
2008/0210216 A1* 9/2008 Rossi et al. ..... 126/39 E
2008/0241777 A1* 10/2008 Rossi et al. ..... 431/354

* cited by examiner

DEVICE AND METHOD FOR A GAS BURNER

BACKGROUND OF THE INVENTION

This invention relates generally to a method and apparatus for gas burners, and, more particularly, a method and apparatus for improved flow characteristics for gas surface burners used in a gas-cooking product.

Atmospheric gas burners are commonly used as surface units in household gas cooking appliances. A significant factor in the performance of gas burners is their ability to withstand airflow disturbances from the surroundings, such as room drafts, rapid movement of cabinet doors, and oven door manipulation. Manipulation of the oven door is particularly troublesome because rapid openings and closings of the oven door often produce respective under-pressure and over-pressure conditions under the cook top.

Gas surface burners used in cooking products typically include a burner body including a plurality of burner ports through which a gas is distributed, and a burner cap positioned over the burner body. Almost all designs include an internal chamber of increased gas volume near the burner ports. This is important where gas flow may change over time. Providing equal flame characteristics from one port to the next is critical to prevent hot spots or uneven heating of the cooking vessels. Variations in the size of the burner port and the distance of the burner port from the venturi can also affect the flame characteristics. Adverse changes in the flame characteristic are detrimental to various performance characteristics such as inability to support flames at certain ports particularly at very low gas input rates. Gas refers to any gas or fuel air mixture.

A larger port exhibits higher flow rates than smaller ports in the same burner for a given input flow. Thus, port sizing, a static attribute of a burner, often determines the flow characteristics of a particular burner at a specific flow. This defines the distribution of flow rates across the burner ports. In some cases, it is desired that the flow characteristics be "Dynamic" or variable. One such instance would be in a burner where the flow characteristics for a region of ports are altered during high flow and unaltered during low flow conditions. For example, where the port designs are optimized for low flow, the ports produce poor and undesirable operational conditions during high flow. This is particularly evident in multiple ring burner assemblies or burners having multiple flame rings.

SUMMARY OF THE INVENTION

As described herein, embodiments of the invention overcome one or more of the above or other disadvantages known in the art.

In one aspect, a gas range having a cook top and a gas burner assembly is connected to a source of gas having a variable flow rate. The burner assembly is positioned in the cook top. The gas burner assembly has a burner body with a gas input, the gas input is in a first flow communication with a first chamber and a second flow communication with a second chamber. Each chamber has at least one port in an exterior wall for flow communication to an area external of the burner body for combustion of the gas. The second flow communication has a tripping pin to deflect flow during high flow conditions and to not deflect flow during low flow conditions. A burner cap is positioned on the burner body.

In another aspect, a method for regulating a gas output of at least one port of a gas range burner assembly having at least one gas input. The method comprising: supplying gas to a first gas input, flowing the gas from the first gas input to a first chamber of a burner body of the burner assembly where the first chamber has at least one burner port. Flowing the gas from the first gas input past a projection to a second chamber of the burner body where the second chamber has at least one burner port. The projection is configured to allow substantially uniform gas distribution through the at least one burner port of the first chamber and the at least one port of the second chamber during a minimum gas input rate, and configured to limit the gas distribution to the at least one burner port of the second chamber at a second input rate greater than the first input rate.

In yet another aspect, a burner body comprises at least one gas input. Each gas input is in a first flow communication with a first chamber and a second flow communication through an opening with a second chamber. Each chamber has at least one port in an exterior wall for flow communication to an area external of the burner body for combustion of the gas. The second flow communication comprises a tripping pin configured between the opening to the second chamber and the at least one gas input.

BRIEF DESCRIPTION OF THE DRAWINGS

The following figures illustrate examples of embodiments of the invention. The figures are described in detail below.

DETAILED DESCRIPTION OF THE INVENTION

While the methods and apparatus are herein described in the context of a gas-fired cook top, as set forth more fully below, it is contemplated that the herein described method and apparatus may find utility in other applications, including, but not limited to, gas heater devices, gas ovens, gas kilns, gas-fired meat smoker devices, and gas barbecues. In addition, the principles and teachings set forth herein may find equal applicability to combustion burners for a variety of combustible fuels. The description herein below is therefore set forth only by way of illustration rather than limitation, and is not intended to limit the practice of the herein described methods and apparatus.

Typically, for a burner chamber, flow distribution is governed by individual port areas. The larger port exhibits higher flow rates than smaller ports. Thus, port sizing, a static attribute of a burner, primarily determines this flow characteristic. This defines the distribution of flow rates across the burner ports. In some cases, it is desired that the flow characteristics be "Dynamic" or variable. One such example of a dynamic flow application would be in a burner where an interior region of ports are altered during high flow and unaltered during low flow conditions. For example, the inside ports are optimized for a particular flow and therefore produce poor and undesirable operational conditions when different flow conditions are experienced. Particularly, the ports require a minimum flow rate to prevent premature extinguishing of the cooking flame, however, due to oxygen requirements for proper burning, also exhibit poor performance during high flow conditions.

Figure 1:
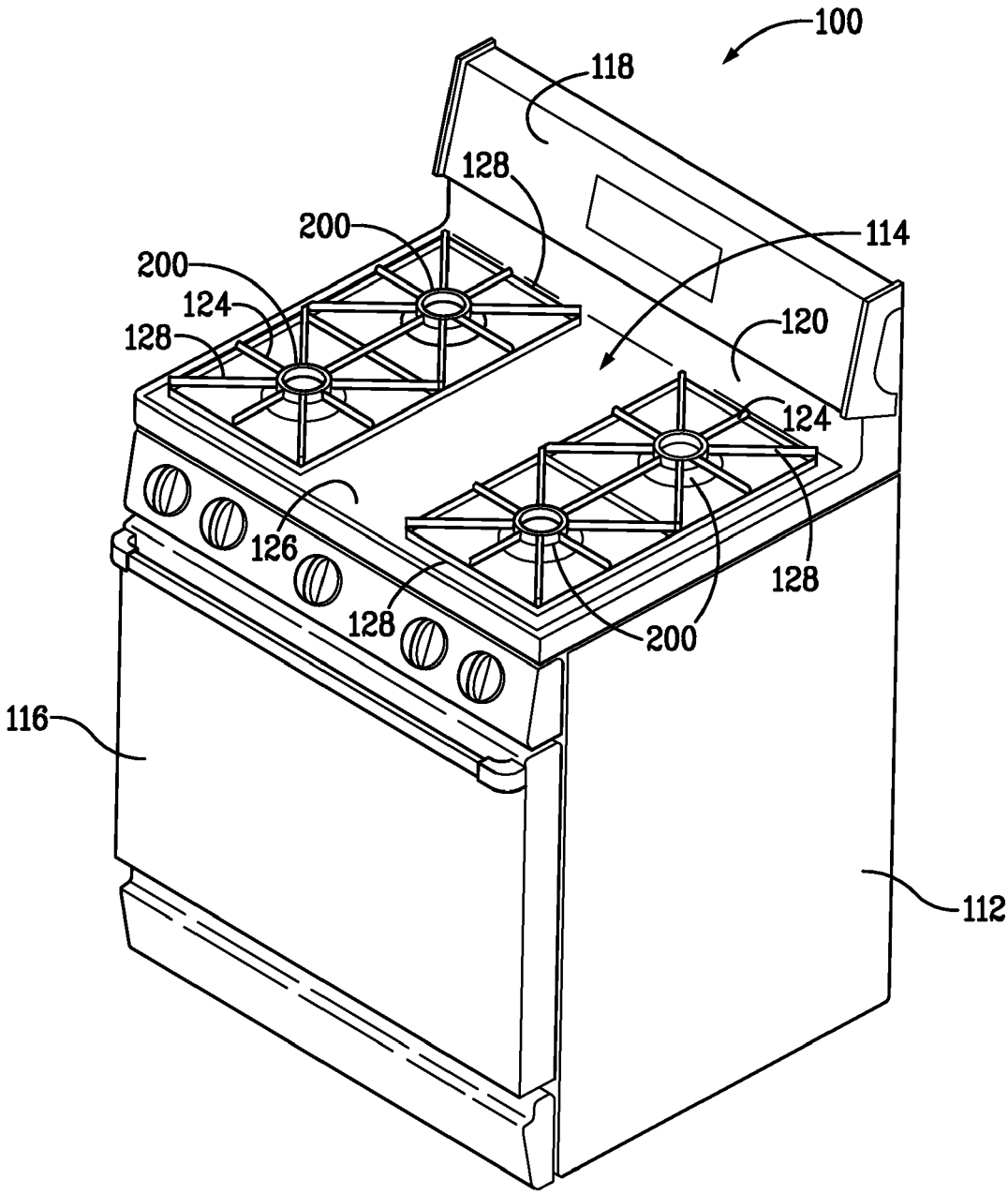
FIG. 1 is a perspective view of a gas range according to an embodiment of the invention.

FIG. 1 illustrates an exemplary freestanding gas range 100 in which the herein described methods and apparatus may be practiced. Range 100 includes an outer body or cabinet 112 that incorporates a generally rectangular cook top 114. An oven, not shown in detail, is positioned below cook top 114 and has a front-opening access door 116. A range backsplash 118 extends upward of a rear edge 120 of cook top 114 and contains various control selectors (not shown) for selecting operative features of heating elements for cook top 114 and the oven. It is contemplated that the herein described apparatus is applicable, not only to cook tops which form the upper portion of a range, such as range 100, but to other forms of cook tops as well, such as, but not limited to, built in cook tops that are mounted to a kitchen counter. Therefore, gas range 100 is provided by way of illustration rather than limitation, and accordingly there is no intention to limit application of the herein described methods and apparatus to any particular appliance or cook top, such as range 100 or cook top 114.

Cook top 114 includes four gas fueled burner assemblies 200 which are positioned in spaced apart pairs positioned adjacent each side of cook top 114. A recessed area 124 of cook top 114 surrounds each burner assembly 200. Recessed area 124 is positioned below an upper surface 126 of cook top 114 and serve to catch any spills from cooking vessels (not shown in FIG. 1) being used with cook top 114. Each burner assembly 200 extends upwardly through an opening in recessed areas 124, and a grate 128 is positioned over each burner 200. Each grate 128 includes a flat surface thereon for supporting cooking vessels and utensils over burner assemblies 200 for cooking of meal preparations placed therein.

While cook top 114 includes four grates 128 positioned over four burner assemblies 200 it is contemplated that greater or fewer numbers of grates could be employed with a greater or fewer number of burners without departing from the scope of the herein described methods and apparatus.

Figure 2:
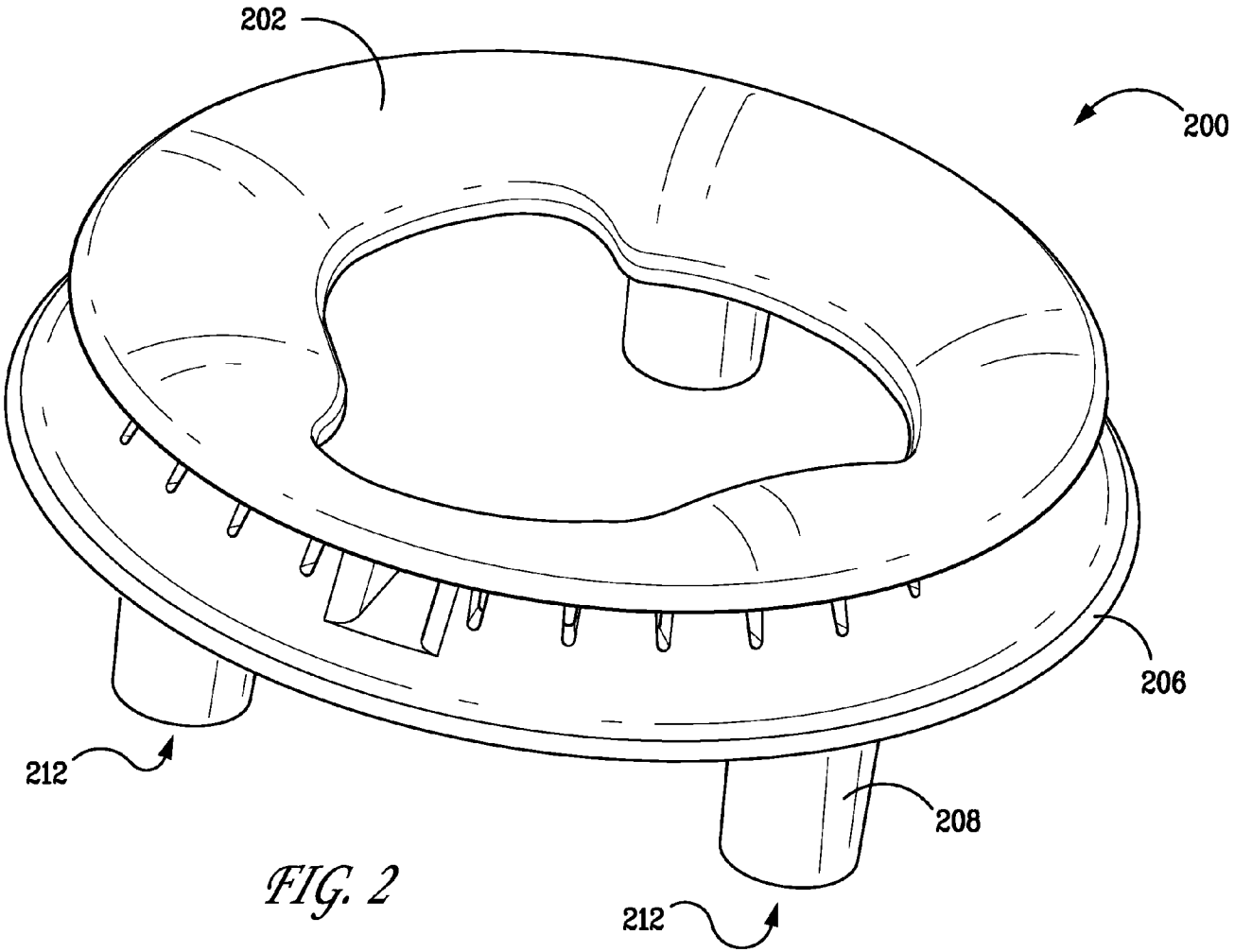
FIG. 2 is a perspective view of a burner assembly of the range of FIG. 1 according to an embodiment of the invention.

FIG. 2 is a perspective view of an exemplary burner assembly 200 that can be used with gas range 100 (shown in FIG. 1). Burner assembly 200 includes a burner cap 202 and a burner body 206. A venturi 208 having an entry area 212 is open to the interior of burner body 206 and defines a passage which extends axially through the base of burner body 206 to provide fuel/air flow to burner assembly 200. As used herein, the term "gas" refers to a combustible gas or gaseous fuel-air mixture.

Burner assembly 200 is mounted on a support surface, such as cook top 114, of a gas-cooking appliance such as a range or a cook top. The cap 202 is disposed over the top of burner body 206. Cap 206 can be fixedly attached or can simply rest on burner body 206 for easy removal. Burner assembly 200 also includes at least one igniter (not shown) extending through an opening in burner body 206. While one type of burner is described and illustrated, the herein described methods and apparatus are applicable to other types of burners, such as stamped aluminum burners and separately mounted orifice burners.

Figure 3:
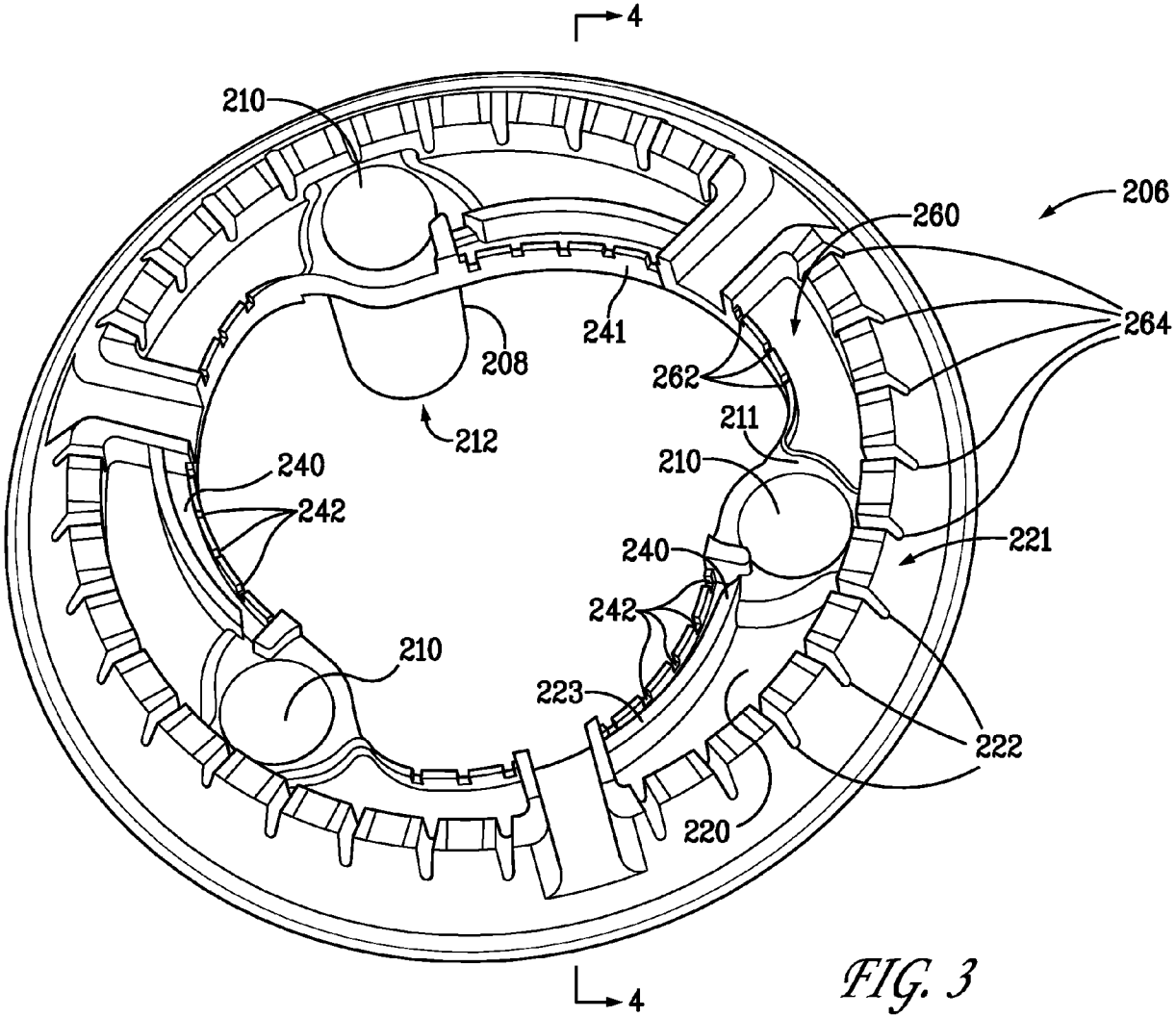
FIG. 3 is a perspective view of a burner body of the burner assembly of FIG. 2 according to an embodiment of the invention.

FIG. 3 is a perspective view of a burner body 206 that can be used with gas range 100 (shown in FIG. 1). Burner body 206 contains at least one input 212 where a gas is introduced. For each input, the gas travels through venturi 208 from entry area 212 to an opening 210. Each opening 210 is in flow communication with a set of chambers 220, 240 and 260. An outer wall 221, an inner wall 223, a lower surface of the burner body 206, and cap 202 define arcuate chamber 220. A plurality of primary burner ports 222 are disposed in outer wall 221. Gas from opening 210 enters chamber 220 over ridge 211 and exits ports 222 for combustion. Primary burner ports 222 are typically, although not necessarily, evenly spaced about outer wall 221. Inner wall 223 separates chamber 220 and chamber 240. A wall 241 further defines chamber 240. A plurality of burner ports 242 are disposed in wall 241. Gas flows from opening 210 over ridge 211 and into chamber 260 then out ports 262 and 264 for combustion. As used herein, the term "port" refers to an aperture of any shape from which a flame may be supported.

Figure 4:
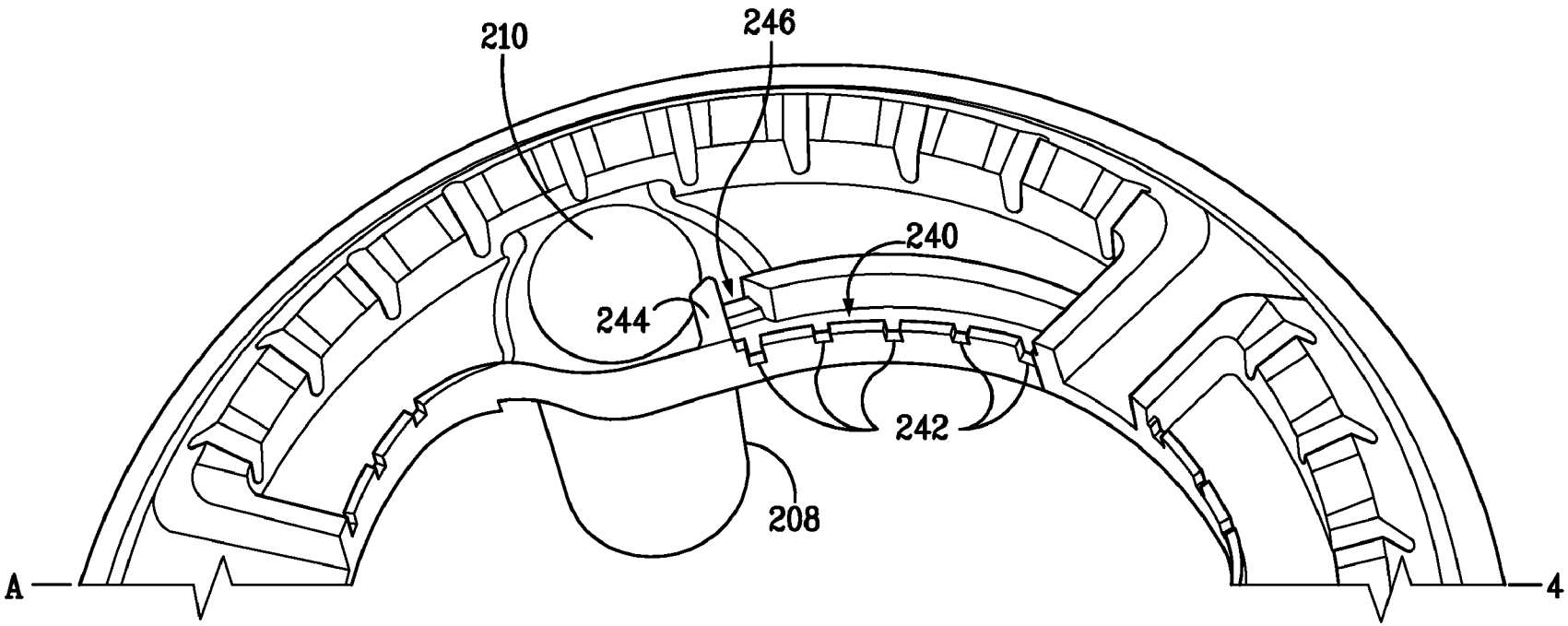
FIG. 4 is a cutaway view of the burner body of along 4-4 in FIG. 3.

FIG. 4 shows the tripping pin 244 and doorway 246. Tripping pin 244 causes the flow of gas to ports 242 to remain relatively consistent even though the flow rate through opening 210 may change. During a change from a first flow rate to a second flow rate, where the first flow rate is less then the second flow rate, tripping pin 244 directs more of the gas to flow past doorway 246. This tripping of the flow reduces the percentage of gas entering chamber 240. Thus, while flow to chamber 240 may increase slightly the percentage of gas entering chamber 240 as compared to the total flow is reduced. As a result, ports 242 may then be optimized for lower flow conditions without producing high flow performance issues when the available oxygen for combustion is limited. This limit in available oxygen occurs from the limited volume within the burner assembly.

Figure 5:
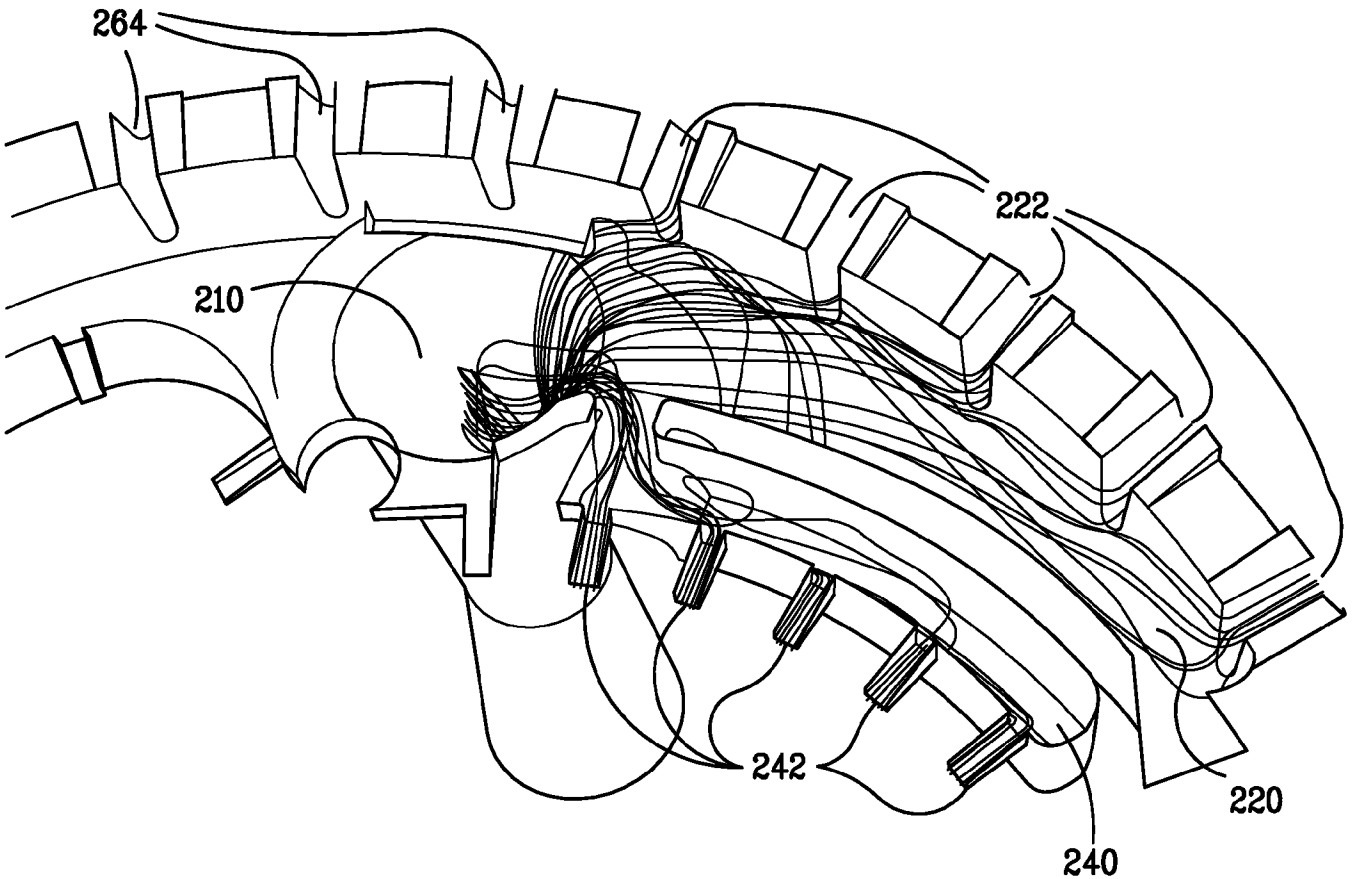
FIG. 5 is a gas flow diagram of one venturi of the burner body of FIG. 3 at a gas flow rate greater then 2 Kbtu/hr.

As shown in FIG. 5 the tripping pin 244 provides a flow deflection and pressure drop during a flow producing greater then 6 Kbtu/hr burner output. The 6 Kbtu/hr burner output is for the entire burner, therefore only 2 Kbtu/hr is experienced by each of the three venturi. The tripping pin 244 works in conjunction with the door 246 by deflecting a majority of the flow around the opening to the door 246. Therefore, only a lower percentage of the flow enters into chamber 240 for flow dispersion to the ports 242. The chamber 240 provides an area sealed from the other chambers 220 and 260 of the burner and allows for an even pressure distribution of flow from opening 210. The indicated flow streams are restricted to only the streams from opening 210 that affect ports 222 and 242, other flow streams, not shown, flow to ports 262 and 264.

Figure 6:
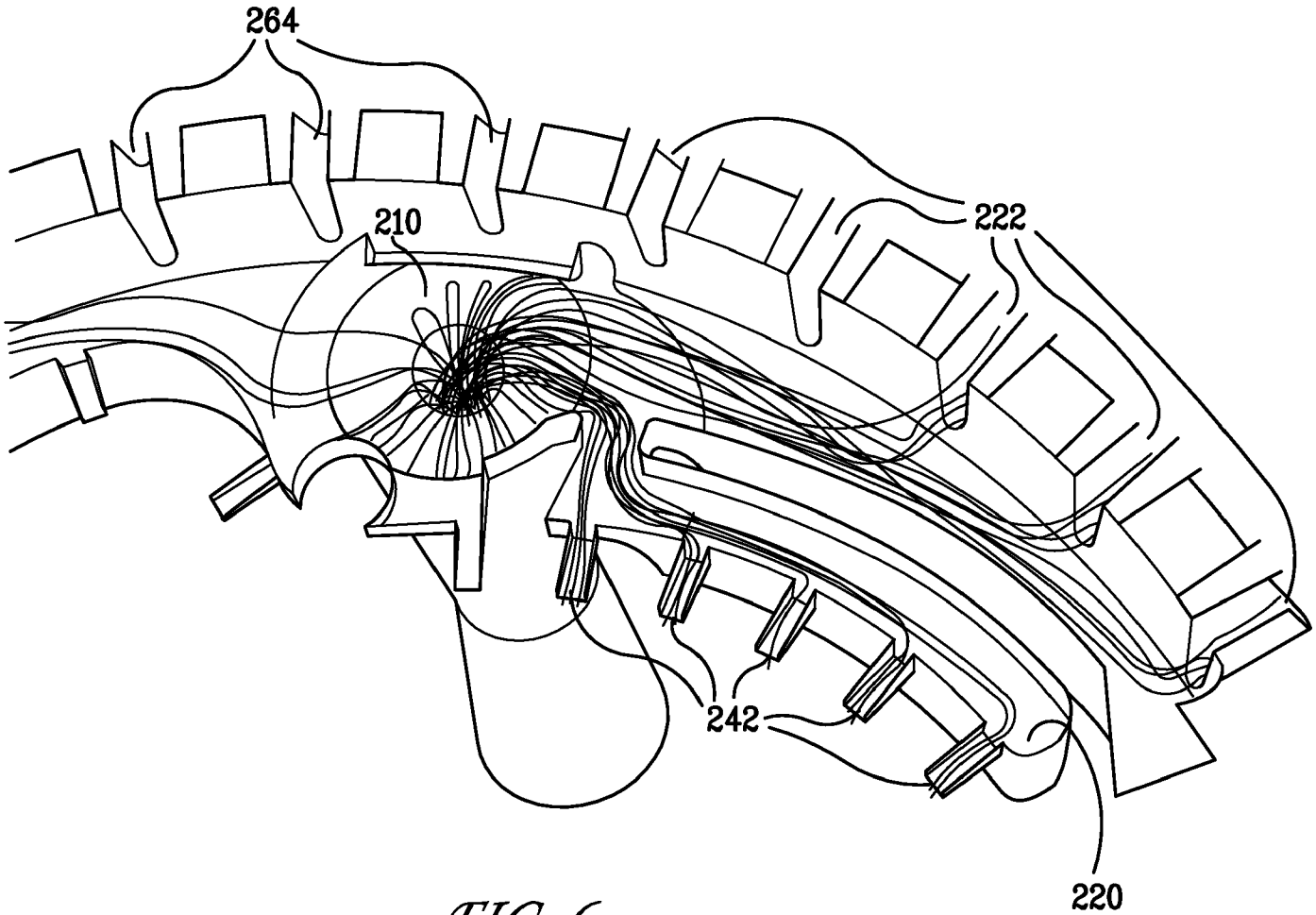
FIG. 6 is a gas flow diagram of one venturi of the burner body of FIG. 3 at a gas flow rate less then 2 Kbtu/hr.

The flow in FIG. 6 depicts a flow model like FIG. 5; however, the flow rate is reduced to produce less then 6 Kbtu/hr total burner output. During reduced flow conditions, the tripping pin 244 and door 246 have a reduced affect on deflecting the flow from chamber 240. A greater percentage of the flow enters chamber 240. Thus, even though there may be a reduced total flow, ports 242 experience only a small decrease in flow.

Figure 7:
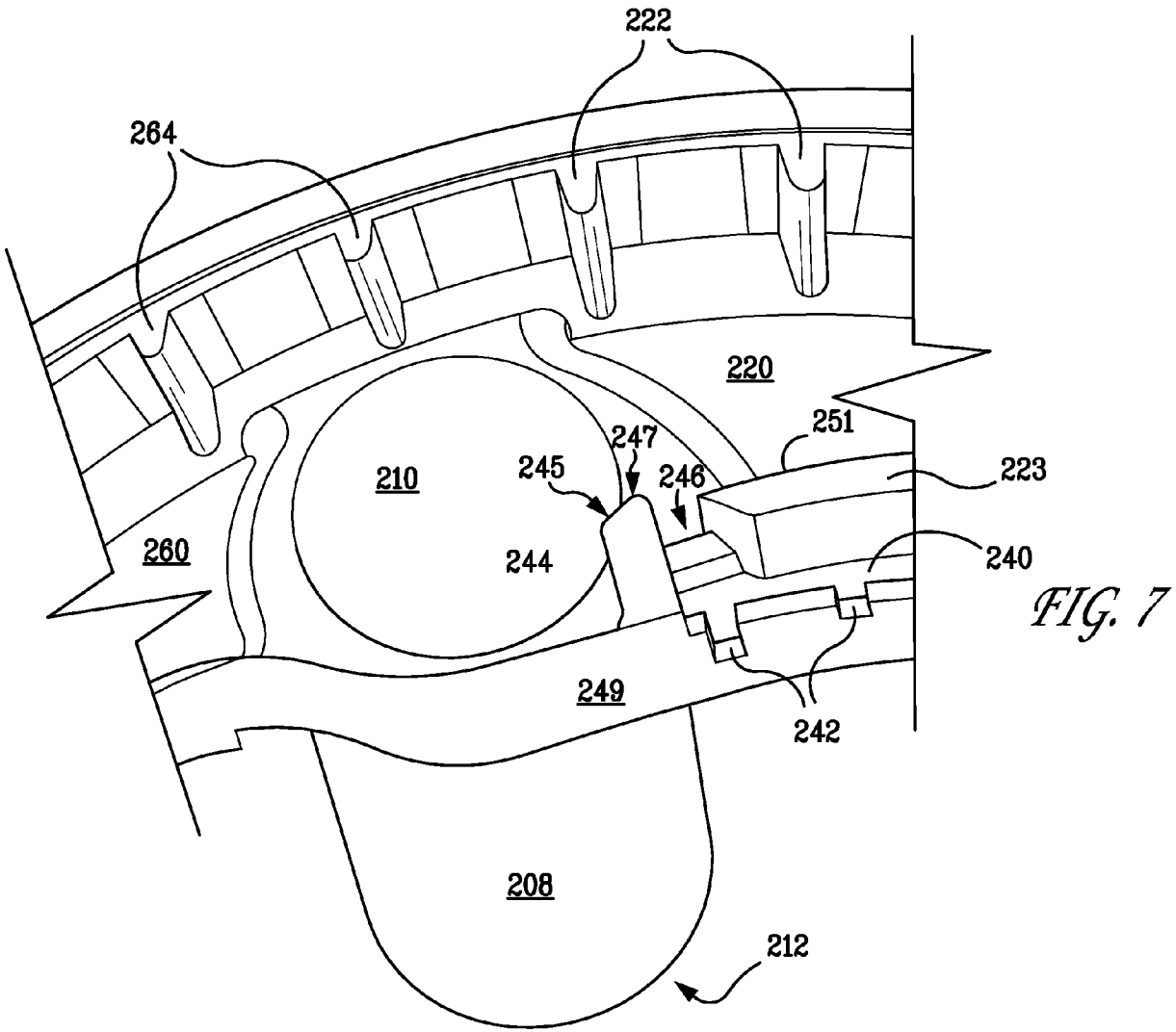
FIG. 7 is a view of the tripping pin of FIG. 3 according to an aspect of the invention.

FIG. 7 is a view of the tripping pin 244 of FIG. 4. Tripping pin 244 causes the flow to chamber 240 to remain consistent over a range of flows from opening 210. Due to the geometry of tripping pin 244 gas exiting 210 at relatively high flow rates is directed past door 246. Door 246 is the only opening for gas to enter 240 to exit ports 242. During relatively high flow rates, as shown in FIG. 5, gas is pushed by edge 245 away from door 246. Further, the distance from wall 249 to corner 247 is greater then the distance from wall 249 to edge 251 of inner wall 223. However, during slower flow conditions, gas flowing from 210 contacts edge 245 and flows around corner 247 and enters door 246, as shown in FIG. 6.

While the invention has been described in terms of various specific embodiments, those skilled in the art will recognize that the invention can be practiced with modification within the spirit and scope of the claims.

What is claimed is:

1. A gas range comprising:

a cooktop; and a gas burner assembly positioned partially above an area of the cooktop, the gas burner assembly comprising:

a burner body comprising:

a gas input connectable to a source of gas;

a first chamber in flow communication with the gas input, the first chamber comprising a first exterior wall having at least one first burner port;

a second chamber comprising a second exterior wall having at least one second burner port;

only one wall separating the first chamber from the second chamber; and a tripping pin disposed upstream of, and separated from the only one wall by a distance to form a doorway between the tripping pin and the only one wall, the gas input being in flow communication with the second chamber through the doorway; and a burner cap positioned on the burner body.

2. The gas range in of claim 1, wherein the burner body further comprises a third chamber in flow communication with the gas input, the third chamber comprising a third exterior wall having at least one third burner port.

3. The gas range of claim 1, wherein the tripping pin is disposed adjacent to the gas input.

4. The gas range of claim 1, wherein the tripping pin is configured so that gas flow to the second chamber remains relatively consistent when gas coming out of the gas input changes from a first flow rate to a second flow rate greater than the first flow rate.

5. The gas range of claim 1, wherein the tripping pin comprises a leading edge and a trailing edge which is disposed radially outward of the leading edge.

6. The gas range of claim 1, wherein the first exterior wall has a plurality of first burner ports.

7. The gas range of claim 1, wherein the second exterior wall has a plurality of second burner ports.

8. A burner assembly comprising:

a burner body comprising:

a gas input connectable to a source of gas;

a first chamber in flow communication with the gas input, the first chamber comprising a first exterior wall having at least one first burner port;

a second chamber comprising a second exterior wall having at least one second burner port;

only one wall separating the first chamber from the second chamber; and a tripping pin disposed upstream of, and separated from the only one wall by a distance to form a doorway between the tripping pin and the only one wall, the gas input being in flow communication with the second chamber through the doorway; and a burner cap positioned on the burner body.

9. The burner assembly of claim 8, wherein the burner body further comprises a third chamber in flow communication with the gas input, the third chamber comprising a third exterior wall having at least one third burner port.

10. The burner assembly of claim 8, wherein the tripping pin is configured so that gas flow to the second chamber remains relatively consistent when gas coming out of the gas input changes from a first flow rate to a second flow rate greater than the first flow rate.

11. The burner assembly of claim 8, wherein the tripping pin is disposed adjacent to the gas input.

12. The burner assembly of claim 8, wherein the tripping pin comprises a leading edge and a trailing edge which is disposed radially outward of the leading edge.

13. The burner assembly of claim 8, wherein the first exterior wall has a plurality of first burner ports.

14. The burner assembly of claim 8, wherein the second exterior wall has a plurality of second burner ports.

* * * * *

UNITED STATES PATENT AND TRADEMARK OFFICE

CERTIFICATE OF CORRECTION

PATENT NO. : 7,614,877 B2
APPLICATION NO. : 11/961258
DATED : November 10, 2009
INVENTOR(S) : McCrorey et al.

It is certified that error appears in the above-identified patent and that said Letters Patent is hereby corrected as shown below:

In Column 5, Line 22, in Claim 2, after "range" delete "in".

Signed and Sealed this

Ninth Day of February, 2010

David J. Kappos

David J. Kappos
*Director of the United States Patent and Trademark Office*